US006615564B2

(12) United States Patent
Lutrario et al.

(10) Patent No.: US 6,615,564 B2
(45) Date of Patent: Sep. 9, 2003

(54) FOR A CONNECTOR FOR JOINING ADJACENT FLAT ROOF PANELS COPLANARLY TOGETHER

(76) Inventors: Don Lutrario, 1545 Woodrow Rd., Staten Island, NY (US) 10309; John Lutrario, Jr., 1545 Woodrow Rd., Staten Island, NY (US) 10309; Peter Lutrario, 1545 Woodrow Rd., Staten Island, NY (US) 10309

( * ) Notice: Subject to any disclaimer, the term of this patent is extended or adjusted under 35 U.S.C. 154(b) by 0 days.

(21) Appl. No.: 09/934,024

(22) Filed: Aug. 21, 2001

(65) Prior Publication Data

US 2003/0037501 A1 Feb. 27, 2003

(51) Int. Cl.[7] ..... E04B 1/61

(52) U.S. Cl. ..... 52/765; 52/730.1; 52/730.3; 52/730.4; 52/731.1; 52/731.2; 52/732.1; 52/734.2; 52/237.6; 52/780

(58) Field of Search ..... 52/DIG. 17, 730.1, 52/730.3, 730.4, 731.1, 731.2, 732.1, 734.2, 737.6, 762, 764, 780

(56) References Cited

U.S. PATENT DOCUMENTS

| | | | | | |
|---|---|---|---|---|---|
| 4,658,559 | A | * | 4/1987 | Doherty | 52/463 |
| D378,424 | S | * | 3/1997 | Leonelli | D25/122 |
| 5,727,356 | A | * | 3/1998 | Ensinger et al. | 52/717.02 |
| D412,584 | S | * | 8/1999 | Shrira | D25/61 |

* cited by examiner

*Primary Examiner*—Carl D. Friedman
*Assistant Examiner*—Steve Varner

(57) ABSTRACT

A connector that joins flat roof panels coplanarly together. The connector includes a body, a neck, a head, a pair of legs, a pair of feet, and a pair of toes. The neck extends upwardly from the body. The head extends transversely across the neck. The pair of legs depend from the body. The pair of feet extend outwardly from the pair of legs, respectively. The pair of toes extend upwardly from the pair of feet, respectively. The body, the neck, and the head together define a pair of opposing channels that coplanarly and slidingly receive the flat roof panels, respectively, so as to form a connection. The pair of legs, the pair of feet, and the pair of toes together define a pair of upwardly opening channels that provide a runoff for any water passing through the connection and running down the pair of legs.

13 Claims, 1 Drawing Sheet

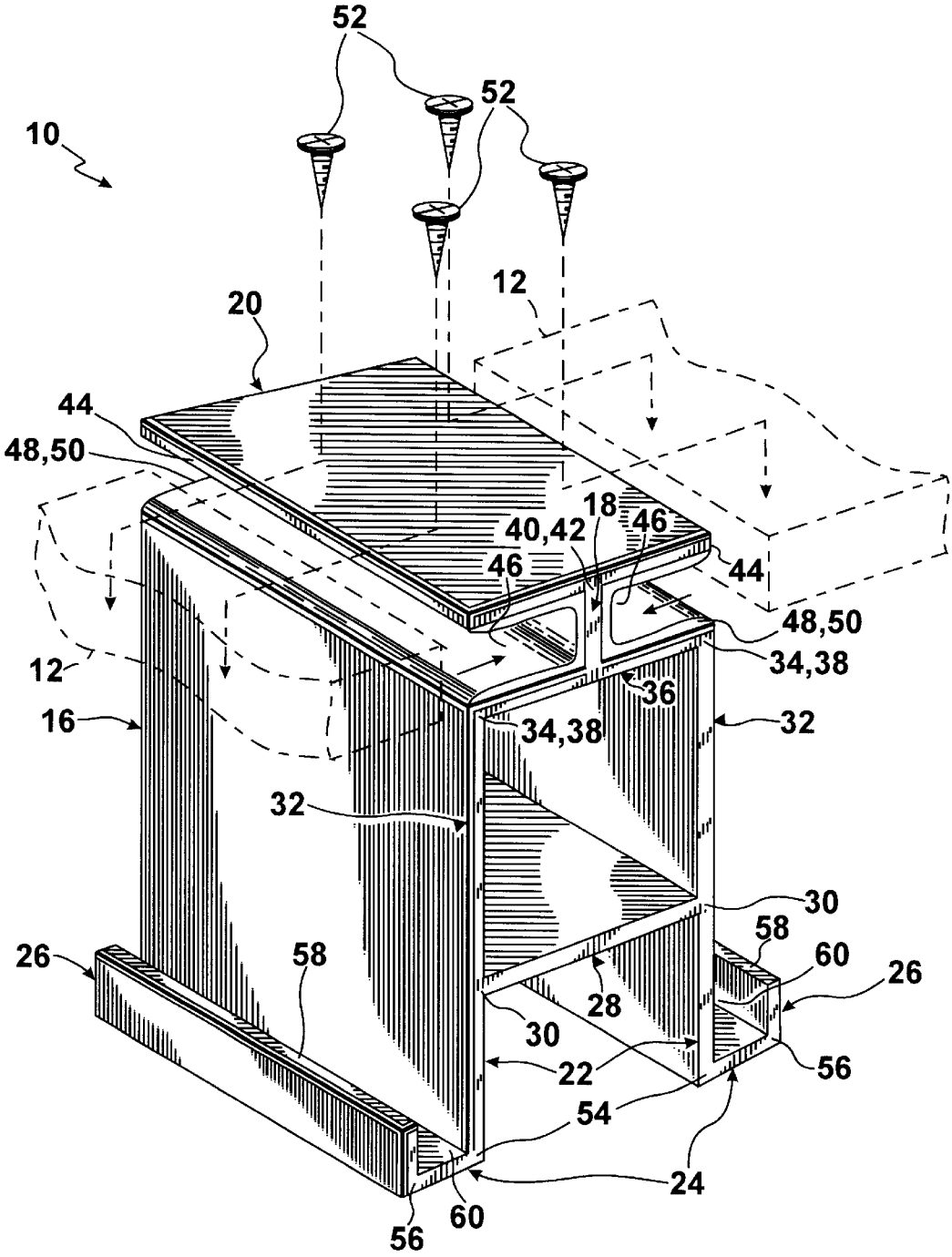
52
52
10
12
20
44
48,50
18
40,42
46
46
44
48,50
34,38
12
36
16
34,38
32
32
30
58
26
58
60
26
28
30
22
56
54
24
60
56

FOR A CONNECTOR FOR JOINING ADJACENT FLAT ROOF PANELS COPLANARLY TOGETHER

BACKGROUND OF THE INVENTION

1. Field of the Invention

The present invention relates to a connector. More particularly, the present invention relates to a connector for joining adjacent flat roof coplanarly together.

2. Description of the Prior Art

Numerous innovations for structural connectors have been provided in the prior art that will be described. Even though these innovations may be suitable for the specific individual purposes to which they address, however, they differ from the present invention.

FOR EXAMPLE, U.S. Pat. No. 4,486,994 to Fisher et al. teaches joints in a panel wall construction that are provided with an internal seal of greatly enhanced airtightness and of enhanced structural strength. This is achieved by forming the panels with the core thereof recessed inwardly from the edges of the skins so that when the panels are positioned in assembled relation in a channel member, a longitudinally extending cavity is provided between the skins. A hardenable filler material, such as foam, is injected into the cavity to completely fill the cavity as well as any cracks or gaps which may exist between the channel member and the skins of the panel.

ANOTHER EXAMPLE, U.S. Pat. No. 4,754,587 to Glaser teaches composite wall panels, their construction and erection into buildings so as to provide a true thermal break across each panel and the several post constructions employed to interconnect a successive series of such panels into coplanar, corner and/or T-intersection arrangements. This result is obtained by providing each wall panel with an insulating core and having the frame members of each panel, though themselves noninsulating, provided with a transverse web wall and interim anchor means. When the interim anchor means have sufficient structural integrity to maintain the frame members into separated front and rear mullion strips a bridge is removed from the web wall. Such panels have sufficient structural integrity to be transported and erected into buildings by virtue of the several post constructions. Each post arrangement itself incorporates combinations of uniquely constructed and arranged interlocking members that present permanent anchor means that operatively interconnect the opposed mullion strips by an insulating compression member.

STILL ANOTHER EXAMPLE, U.S. Pat. No. 5,056,290 to Alexander et al. teaches an improved method, assembly and a connector apparatus for assembling together a plurality of panels. The connector apparatus includes structure which forms a sealing material reservoir and which can form panel cavities when a panel is seated on the apparatus. The channel type reservoir facilitates the even application of sealant material to the apparatus.

YET ANOTHER EXAMPLE, U.S. Pat. No. 6,003,279 to Schneider teaches a thermally efficient and low maintenance enclosed structure, such as a sunroom, that is made from a framework of joined structural members, thermally insulating kick panels, windows, optional door assembly, optional skylights, and a roof. The structural members include reinforced and non-reinforced polyvinyl chloride extrusions. The structural members are joined together at joints using hardware which cannot be seen from inside or outside the enclosure thereby enhancing the aesthetic appeal of the enclosure. Machines for making the enclosure from a small number of extruded profiles are also described.

STILL YET ANOTHER EXAMPLE, U.S. Pat. No. 6,158,190 to Seng teaches a composite building stud that combines two metal shapes, inner and outer, with an insulating material to form a composite structural member having an insulating valve (R-value) greater than a similar metal member normally used as a stud in a residential structure. The composite also has a strength comparable to that of a similar steel member normally used as a stud in a residential structure. One shape encompasses the other shape. The composite structural member eliminates any direct metal connections and thus eliminates any thermal shorts that reduce the overall insulating value (R-value) of the composite member. The shapes, inner and outer, with an insulating material form a composite structural member that has an interlocking shape which holds the insulating material in compression and mechanically couples the inner and outer members.

It is apparent that numerous innovations for structural connectors have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a connector for joining adjacent flat roof panels coplanarly together that avoids the disadvantages of the prior art.

ANOTHER OBJECT of the present invention is to provide a connector for joining adjacent flat roof panels coplanarly together that is simple to use.

BRIEFLY STATED, STILL ANOTHER OBJECT of the present invention is to provide a connector that joins flat roof panels coplanarly together. The connector includes a body, a neck, a head, a pair of legs, a pair of feet, and a pair of toes. The neck extends upwardly from the body. The head extends transversely across the neck. The pair of legs depend from the body. The pair of feet extend outwardly from the pair of legs, respectively. The pair of toes extend upwardly from the pair of feet, respectively. The body, the neck, and the head together define a pair of opposing channels that coplanarly and slidingly receive the flat roof panels, respectively, so as to form a connection. The pair of legs, the pair of feet, and the pair of toes together define a pair of upwardly opening channels that provide a runoff for any water passing through the connection and running down the pair of legs.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The sole FIGURE of the drawing is an exploded diagrammatic perspective view of the connector of the present invention joining flat roof panels coplanarly together.

LIST OF REFERENCE NUMERALS UTILIZED IN THE DRAWING

10 connector of present invention for joining flat roof panels
12 coplanarly together

12 flat roof panels
16 body
18 neck
20 head
22 pair of legs
24 pair of feet
26 pair of toes
28 bottom wall of body 16
30 pair of terminal edges of bottom wall 28 of body 16
32 pair of side walls of body 16
34 pair of uppermost terminal edges of pair of side walls 32 of body 16, respectively
36 top wall of body 16
38 pair of terminal edges of top wall 36 of body 16
40 midline of top wall 36 of body 16
42 uppermost terminal edge of neck 18
44 pair of free terminal edges of head 20
46 pair of opposing channels for coplanarly and slidingly receiving flat roof panels 12, respectively
48 silicone lining pair of opposing channels 46 for allowing for expansion and contraction of flat roof panels 12, while providing a watertight seal between flat roof panels 12 and connector 10
50 rubber gasket lining pair of opposing channels 46 for allowing for expansion and contraction of flat roof panels 12, while providing a watertight seal between flat roof panels 12 and connector 10
52 plurality of self-tapping screws of head 20 for threading into flat roof panels 12 without entering top wall 36 of body 16 so as to maintain flat roof panels 12 in place in connector 10 without compromising expansion and contraction of flat roof panels 12
54 pair of lowermost terminal edges of pair of legs 32, respectively
56 pair of outermost terminal edges 56 of pair of feet 24, respectively
58 pair of uppermost free terminal edges of pair of toes 26, respectively
60 pair of upwardly opening channels for providing runoff for any water passing through watertight seal between flat roof panels 12 and connector 10 and running down pair of legs 32

DETAILED DESCRIPTION OF THE PREFERRED EMBODIMENT

Referring now to the sole FIGURE of the drawing, which is an exploded diagrammatic perspective view of the connector of the present invention joining flat roof panels coplanarly together, and in which like numerals indicate like parts, the connector of the present invention is shown generally at 10 for joining flat roof panels 12 coplanarly together.

The connector 10 comprises a body 16, a neck 18 that extends upwardly from the body 16, a head 20 that extends transversely across the neck 20, a pair of legs 22 that depend from the body 16, a pair of feet 24 that extend outwardly from the pair of legs 22, respectively, and a pair of toes 26 that extend upwardly from the pair of feet 24, respectively.

The connector 10 is a one-piece aluminum extrusion.

The body 16 is elongated, and has a bottom wall 28 that is flat, rectangular-shaped, horizontally-oriented, and has a pair of terminal edges 30, a pair of side walls 32 that are flat, rectangular-shaped, vertically-oriented, parallel to each other, and extend perpendicularly upwardly from the pair of terminal edges 30 of the bottom wall 28 of the body 16, respectively, to a pair of uppermost terminal edges 34, respectively, and a top wall 36 that is flat, rectangular-shaped, horizontally-oriented, parallel to the bottom wall of the body 16, and extends perpendicularly from the uppermost terminal edge 34 of one side wall 32 of the body 16 perpendicularly to the uppermost terminal edge 34 of the other side wall 32 of the body 16 so as to form with the bottom wall 28 of the body 16 and the pair of side walls 32 of the body 16 a square box in lateral cross section.

The top wall 36 of the body 16 has a pair of terminal edges 38 that are coincident with the pair of uppermost terminal edges 34 of the pair of side walls 32 of the body 16, respectively, and a midline 40 that is disposed midway between the pair of terminal edges 38 of the top wall 36 of the body 16.

The neck 18 is flat, rectangular-shaped, vertically-oriented, and extends perpendicularly upwardly from the midline 40 of the top wall 36 of the body 16 to an uppermost terminal edge 42.

The head 20 is flat, rectangular-shaped, horizontally-oriented, and extends, perpendicularly across the uppermost terminal edge 42 of the neck 18 to a pair of free terminal edges 44 that are equidistantly spaced from the uppermost terminal edge 42 of the neck 18 and inline with the pair of side walls 32 of the body 16, respectively.

The top wall 36 of the body 16, the neck 18, and the head 20 together define a pair of opposing channels 46 that are for coplanarly and slidingly receiving the flat roof panels 12, respectively.

The pair of opposing channels 46 are lined with one of silicone 48 and a rubber gasket 50 for allowing for expansion and contraction of the flat roof panels 12, while providing a watertight seal between the flat roof panels 12 and the connector 10.

The head 20 further has a plurality of self-tapping screws 52 that extend therein, straddle the neck 18, and are for threading into the flat roof panels 12 without entering the top wall 36 of the body 16 so as to maintain the flat roof panels 12 in place in the connector 10 without compromising expansion and contraction of the flat roof panels 12.

The pair of legs 32 are flat, rectangular-shaped, vertically-oriented, parallel to each other, and extend perpendicularly downwardly from the pair of terminal edges 30 of the bottom wall 28 of the body 16, respectively, to a pair of lowermost terminal edges 54, respectively, and are coplanar with the pair of side walls 32 of the body 16, respectively.

The pair of feet 24 are flat, rectangular-shaped, horizontally-oriented, coplanar with each other, and extend perpendicularly outwardly from the pair of lowermost terminal edges 54 of the pair of legs 22, respectively, to a pair of outermost terminal edges 56, respectively.

The pair of toes 26 are flat, rectangular-shaped, vertically-oriented, parallel to each other, and extend perpendicularly upwardly from the pair of outermost terminal edges 56 of the pair of feet 24, respectively, to a pair of uppermost free terminal edges 58, respectively.

The pair of legs 22, the pair of feet 24, and the pair of toes 58 together define a pair of upwardly opening channels 60 for providing a runoff for any water passing through the watertight seal and running down the pair of legs 32.

It will be understood that each of the elements described above, or two or more together, may also find a useful application in other types of constructions differing from the types described above.

While the invention has been illustrated and described as embodied in a connector for joining flat roof panels coplanarly together, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A connector for joining flat roof panels coplanarly together, comprising:

a) a body;

b) a neck;

c) a head;

d) a pair of legs;

e) a pair of feet; and f) a pair of toes;

wherein said neck extends upwardly from said body;

wherein said head extends transversely across said neck;

wherein said pair of legs depend from said body;

wherein said pair of feet extend outwardly from said pair of legs, respectively;

wherein said pair of toes extend upwardly from said pair of feet, respectively;

wherein said body is elongated;

wherein said body has a bottom wall;

wherein said bottom wall of said body is flat;

wherein said bottom wall of said body is rectangular-shaped;

wherein said bottom wall of said body is horizontally-oriented;

wherein said bottom wall of said body has a pair of terminal edges;

wherein said body has a pair of side walls;

wherein said pair of side walls of said body are flat;

wherein said pair of side walls of said body are rectangular-shaped;

wherein said pair of side walls of said body are vertically-oriented;

wherein said pair of side walls of said body are parallel to each other;

wherein said pair of side walls of said body extend perpendicularly upwardly from said pair of terminal edges of said bottom wall of said body, respectively, to a pair of uppermost terminal edges, respectively;

wherein said body has a top wall;

wherein said top wall of said body is flat;

wherein said top wall of said body is rectangular-shaped;

wherein said top wall of said body is horizontally-oriented;

wherein said top wall of said body is parallel to said bottom wall of said body;

wherein said top wall of said body extends perpendicularly from said uppermost terminal edge of one side wall of said body perpendicularly to said uppermost terminal edge of the other side wall of said body; and wherein said bottom wall of said body, said pair of side walls of said body, and said top wall of said body together form a box in lateral cross section.

2. The connector as defined in claim 1, wherein said connector is a one-piece aluminum extrusion.

3. The connector as defined in claim 1, wherein said top wall of said body has a pair of terminal edges;

wherein said pair of terminal edges of said top wall of said body are coincident with said pair of uppermost terminal edges of said pair of side walls of said body, respectively;

wherein said top wall of said body has a midline; and wherein said midline of said top wall of said body is disposed midway between said pair of terminal edges of said top wall of said body.

4. The connector as defined in claim 3, wherein said neck is flat;

wherein said neck is rectangular-shaped;

wherein said neck is vertically-oriented; and wherein said neck extends perpendicularly upwardly from said midline of said top wall of said body to an uppermost terminal edge.

5. The connector as defined in claim 4, wherein said head is flat;

wherein said head is rectangular-shaped;

wherein said head is horizontally-oriented;

wherein said head extends perpendicularly across said uppermost terminal edge of said neck to a pair of free terminal edges;

wherein said pair of free terminal ends of said head are equidistantly spaced from said uppermost terminal edge of said neck; and wherein said pair of free terminal ends of said head are inline with said pair of side walls of said body, respectively.

6. The connector as defined in claim 1, wherein said top wall of said body, said neck, and said head together define a pair of opposing channels;

wherein said pair of opposing channels are for coplanarly receiving the flat roof panels, respectively; and wherein said pair of opposing channels are for slidingly receiving the flat roof panels, respectively.

7. The connector as defined in claim 6, wherein said pair of opposing channels are lined with silicone for allowing for expansion and contraction of the flat roof panels, while providing a watertight seal between the flat roof panels and said connector.

8. The connector as defined in claim 7, wherein said pair of legs, said pair of feet, and said pair of toes together define a pair of upwardly opening channels; and wherein said pair of upwardly opening channels are for providing a runoff for any water passing through said watertight seal and running down said pair of legs.

9. The connector as defined in claim 6, wherein said pair of opposing channels are lined with a rubber gasket for allowing for expansion and contraction of the flat roof panels, while providing a watertight seal between the flat roof panels and said connector.

10. The connector as defined in claim 1, wherein said head has a plurality of self-tapping screws;

wherein said plurality of self-tapping screws straddle said neck; and wherein said plurality of self-tapping screws are for threading into the flat roof panels without entering said top wall of said body so as to maintain the flat roof panels in place in said connector without compromising expansion and contraction of the flat roof panels.

11. The connector as defined in claim 1, wherein said pair of legs are flat;

wherein said pair of legs are rectangular-shaped;

wherein said pair of legs are vertically-oriented;

wherein said pair of legs are parallel to each other;

wherein said pair of legs extend perpendicularly downwardly from said pair of terminal edges of said bottom wall of said body, respectively, to a pair of lowermost terminal edges, respectively; and wherein said pair of legs are coplanar with said pair of side walls of said body, respectively.

12. The connector as defined in claim 11, wherein said pair of feet are flat;

wherein said pair of feet are rectangular-shaped;

wherein said pair of feet are horizontally-oriented;

wherein said pair of feet are coplanar with each other; and wherein said pair of feet extend perpendicularly outwardly from said pair of lowermost terminal edges of said pair of legs, respectively, to a pair of outermost terminal edges, respectively.

13. The connector as defined in claim 12, wherein said pair of toes are flat;

wherein said pair of toes are rectangular-shaped;

wherein said pair of toes are vertically-oriented;

wherein said pair of toes are parallel to each other; and wherein said pair of toes extend perpendicularly upwardly from said pair of outermost terminal edges of said pair of feet, respectively, to a pair of uppermost free terminal edges, respectively.

* * * * *